US006014796A

United States Patent [19]

Harrison et al.

[11] Patent Number: 6,014,796

[45] Date of Patent: Jan. 18, 2000

[54] SEAT BELT BUCKLE

[75] Inventors: Mark John Harrison, Belfast; Michael John Jackson, Cullybackey, both of United Kingdom

[73] Assignee: European Components Co. Limited, Dundonald, United Kingdom

[21] Appl. No.: 09/089,542

[22] Filed: Jun. 3, 1998

[30] Foreign Application Priority Data

Jun. 6, 1997 [GB] United Kingdom ..... 9711827

[51] Int. Cl.[7] ..... A44B 11/00

[52] U.S. Cl. ..... 24/633; 24/640; 24/642

[58] Field of Search ..... 24/633, 639, 640, 24/642, 635

[56] References Cited

U.S. PATENT DOCUMENTS

| | | | |
|---|---|---|---|
| 3,935,618 | 2/1976 | Fohl | 24/230 AL |
| 4,100,657 | 7/1978 | Minolla | 24/230 AL |
| 4,404,715 | 9/1983 | Sugimoto | 24/633 |
| 4,468,843 | 9/1984 | Duclos et al. | 24/642 |
| 4,662,041 | 5/1987 | Holmberg | 24/640 |
| 4,998,328 | 3/1991 | Tanaka | 24/639 |
| 5,067,211 | 11/1991 | Van Riesen | 24/633 |

FOREIGN PATENT DOCUMENTS

| | | | |
|---|---|---|---|
| 0217704 | 1/1985 | Germany | 24/633 |
| 2 148 380 | 5/1995 | United Kingdom . | |

*Primary Examiner*—Victor N. Sakran
*Attorney, Agent, or Firm*—Foley & Lardner

[57] ABSTRACT

A seat belt buckle for use with a tongue 16, associated with a seat belt, includes a frame 10, in which is mounted an ejector 20, operable by an ejector spring 22. Insertion of the tongue pushes a retainer 30 down a track 26, against the action of a retainer spring 32. The track is inclined at an angle α to the path 15 of the tongue and extends outwardly away from the path in the direction of insertion of the tongue. When the tongue has been inserted an adequate amount, the retainer 30, e.g. a ball returns up the ramp under the influence of the spring 32 and engages in an aperture 18 in the tongue to retain the tongue in the locked condition. Operation of a release mechanism 42 disengages the retainer from the aperture thereby to release the tongue.

5 Claims, 2 Drawing Sheets

SEAT BELT BUCKLE

BACKGROUND OF THE INVENTION

The present invention relates to a seat belt buckle. Seat belt buckles have been available for very many years now and are now rather sophisticated and complicated mechanisms. Several types of buckle include a frame, and a tongue adapted to be carried on the seat belt and slidably insertable into the frame along a planar path.

An ejector is provided which is spring urged to be able to push the tongue out again at an appropriate moment.

Various different forms of locking mechanisms are provided which are usually very complex and therefore rather expensive to manufacture. For example, U.S. Pat. No. 4,100,657 discloses a buckle in which insertion of the tongue in one direction against the bias of the ejector is associated with motion of a release button in the opposite direction. A ramp on the release button forces a roller into an opening in the tongue. This mechanism requires the co-ordinated motion of the ejector and release button. The inclination of the ramp is also such that even when the buckle and tongue are under load, a slight pressure on the release button will eject the tongue.

SUMMARY OF THE INVENTION

According to the present invention there is provided a seat belt buckle comprising a frame, a tongue adapted to be carried by the seat belt and slidably insertable into the frame along a planar path in an insertion direction, an aperture provided in said tongue, an ejector slidable in said frame along said path and engagable by said tongue when inserted in said frame, an ejector spring urging said ejector in a direction to push said tongue in the reverse direction along said path, a track inclined at an acute angle to said planar path and extending at said acute angle outwardly away from said planar path in said insertion direction, a retainer movable along said track and lockingly engagable in the aperture in the tongue at a location where the track intersects the path, a retainer spring positioned effective to urge said retainer along the track towards the path, and a release mechanism adapted to disengage the retainer from the aperture, thereby to release the tongue.

It will be appreciated that the structure of the present invention can be made extremely simply with a very small number of working parts. Nonetheless the seat belt buckle of the present invention can be adequately strong and at least as reliable in use as conventionally available seat belt buckles.

The track may simply be a ramp formed in the frame, and may include a recessed portion accurately to guide the retainer along the track.

In a preferred structure the retainer is simply a steel ball, but other structures are contemplated including a roller, or a suitably shaped slider block.

BRIEF DESCRIPTION OF THE DRAWINGS

In order that the present invention may more readily be understood, the following description is given, merely by way of example, reference being made to the accompanying drawings in which.

DETAILED DESCRIPTION OF THE PREFERRED EMBODIMENTS

Figure 1:
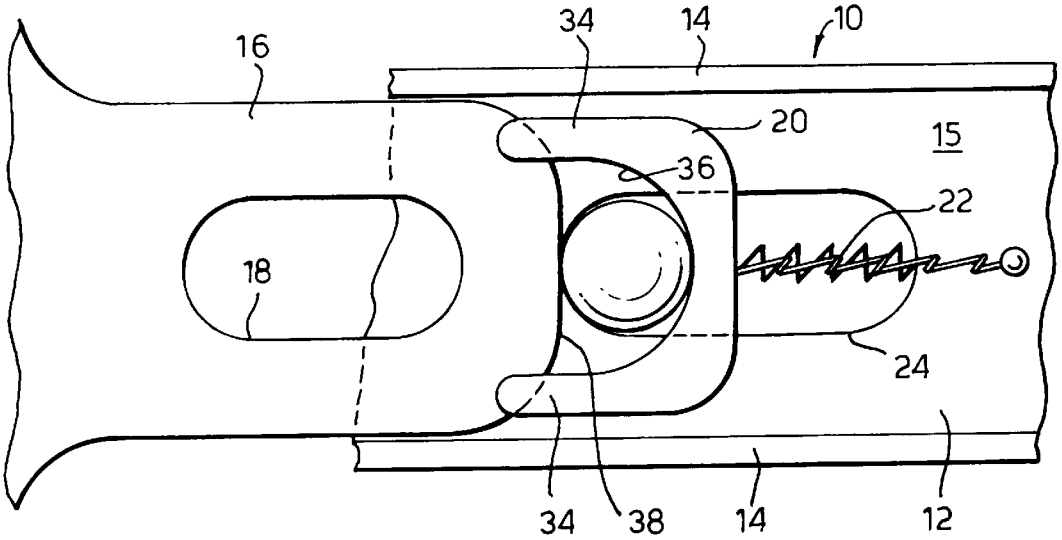
FIG. 1 is a plan view of one embodiment of seat belt buckle according to the present invention.

Referring to the drawings, FIG. 1 illustrates a frame 10, including a flat base 12, and two upstanding side walls 14. Although not shown in the drawing, the top of the side walls will include inwardly directed flanges which, together with the side walls and base, define an elongate slot defining a planar path 15 into which may be inserted the tongue 16 which is conventionally attached to a seat belt, the tongue having an aperture 18 therein.

Also mounted slidably in the frame is an ejector 20 which is urged to the left, as seen in FIG. 1, by an ejector spring 22.

Formed in the base 12 of the frame is an elongate aperture 24 having semi-circular rounded ends.

Formed integrally with, or mounted on the bottom of the base is a track 26 defined by the upper surface of a ramp 28. Slidable or rollable along the ramp 28 is a retainer 30 shown in the form of a spherical ball. Associated with the retainer is a retainer spring 32 which urges the retainer upwardly and to the left as shown in FIG. 2.

If reference is again made to FIG. 1, it will be seen that the ejector 20 includes two arms 34 which define therebetween a semi-circular surface 36.

Figure 2:
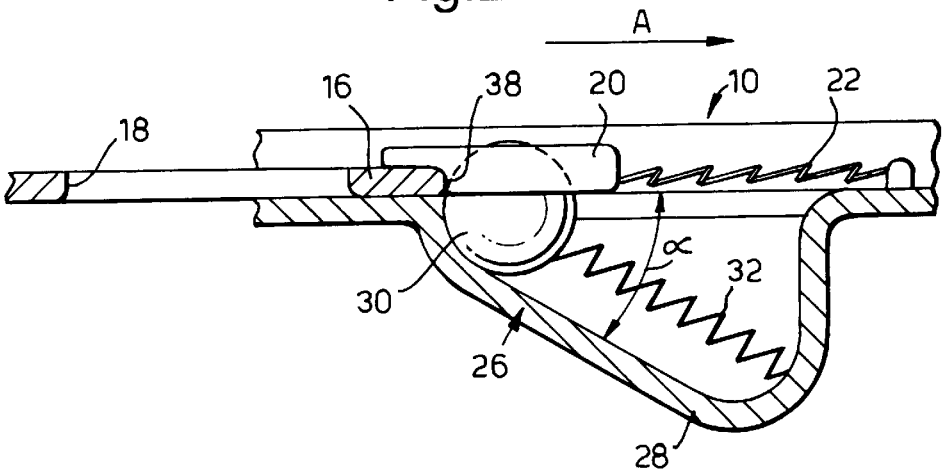
FIG. 2 is a side elevation, partly in section, of the buckle of FIG. 1 in the locked position.
Figure 3:
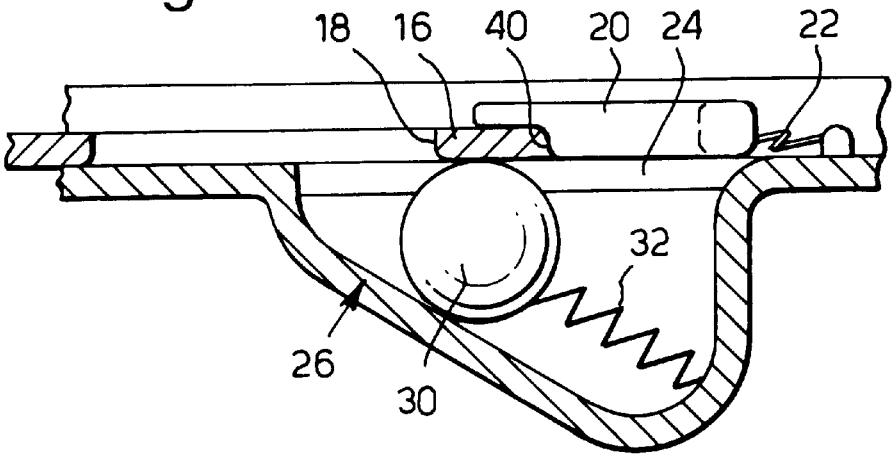
FIGS. 3, 4 and 5 show various movements of the retainer of the buckle of FIGS. 1 and 2.
Figure 4:
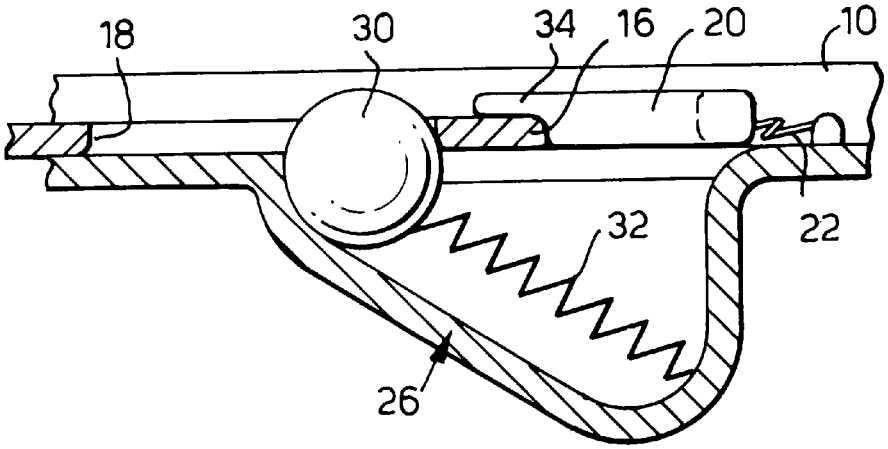

If reference is made now to FIGS. 3 and 4, in combination with FIG. 2, in use the tongue 16 is inserted into the slot defined in the frame, and the leading edge 38 of the tongue abuts the front surface of the retainer ball 30 and pushes it downwardly along the track 26. The track is inclined at an acute angle $\alpha$ to the path of the tongue and extends outwardly away from the path in the insertion direction, indicated by the arrow A, of the tongue, as illustrated, so that the retainer is naturally pushed out of the way by the leading edge of the tongue.

The leading edge also abuts a surface 40 on the ejector 20 and pushes it to the right against the action of the ejector spring 22.

As the tongue moves further to the right, the retainer spring 32 is able to push the retainer ball 30 again up the ramp 28 so that it enters, through the slot 24, the aperture 18 in the tongue. This position is illustrated in FIG. 4.

At this stage the ejector 20, which includes the arms 34, extending over the forward end of the tongue 16, urges the tongue backwardly. In this position the retainer ball 30 prevents the tongue moving any further to the left, and hence retains the tongue in this locked condition. Any load applied which tends to move the tongue to the left simply holds the retainer ball more securely in the locked position and also resists operation of a release mechanism to avoid inadvertent release of the tongue. This is because to release the tongue, the retainer ball must move down and to the right against any force urging it to the left.

Figure 5:
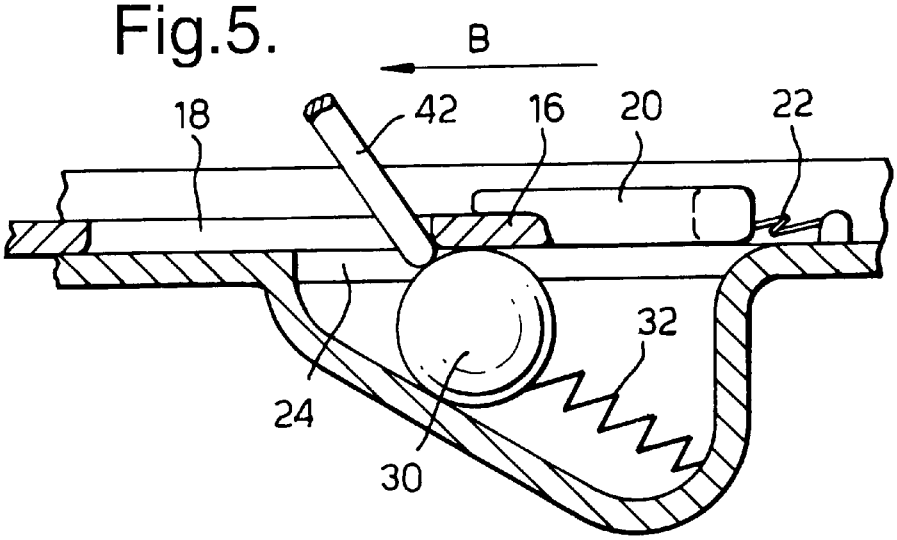

In order to release the buckle, the latter may be provided with a release button which forms part of a release mechanism including a release pin 42, which, when operated, passes through the aperture 18, and the slot 24, to engage the retainer ball 30, thereby to push the ball retainer 30 down the ramp or track 26, against the action of the spring 32 (see FIG. 5).

When the retainer ball 30 reaches the position illustrated in FIG. 5, it is below the forward end of the tongue 16, and the ejector spring 22 can then move the ejector 20, and thus the tongue 16, in the reverse direction indicated by the arrow B to the left to be released.

It will be appreciated that this structure is very simple and is therefore inexpensive to manufacture, while being capable of operating reliably.

We claim:

1. A seat belt buckle comprising a frame, a tongue adapted to be carried by the seat belt and slidably insertable into the frame along a planar path in an insertion direction, an aperture provided in said tongue, an ejector slidable in said frame along said path and engagable by said tongue when inserted in said frame, an ejector spring urging said ejector in a direction to push said tongue in the reverse direction along said path, a track inclined at an acute angle to said planar path and extending at said acute angle outwardly away from said planar path in said insertion direction, a retainer movable along said track and lockingly engagable in the aperture in the tongue at a location where the track intersects the path, a retainer spring positioned effective to urge said retainer along the track towards the path, and a release mechanism adapted to disengage the retainer from the aperture, thereby to release the tongue.

2. A buckle according to claim 1, wherein the track is a ramp formed in the frame.

3. A buckle according to claim 1, wherein the retainer is a ball.

4. A buckle according to claim 1, wherein the retainer is a roller.

5. A seat belt buckle for locking the tongue of a safety belt restraint, the buckle comprising:

a frame having a planar path and adapted for slidably receiving the tongue along the planar path in an insertion direction;

an ejector slidable in the frame along the planar path and adapted to engage the tongue when the tongue is inserted in the frame;

an ejector spring urging the ejector in a direction to push the tongue along the planar path in a direction opposite to the insertion direction;

a track inclined at an acute angle to the planar path and extending at the acute angle outwardly away from the planar path in the insertion direction;

a retainer movable along the track and adapted for locking the tongue by engaging an aperture in the tongue at a location where the track intersects the planar path;

a retainer spring positioned effective to urge the retainer along the track towards the path; and a release mechanism adapted to release the tongue by disengaging the retainer from the aperture.

* * * * *